US009338836B2

(12) United States Patent
Chien

(10) Patent No.: US 9,338,836 B2
(45) Date of Patent: May 10, 2016

(54) MULTIPLE DISPLAY-UNITS LED LIGHT DEVICE HAS SPECIAL LIGHT EFFECTS

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 13/923,721

(22) Filed: Jun. 21, 2013

(65) Prior Publication Data

US 2014/0375532 A1 Dec. 25, 2014

Related U.S. Application Data

(63) Continuation-in-part of application No. 11/527,629, filed on Sep. 27, 2006, now Pat. No. 8,545,090.

(51) Int. Cl.
*G09G 3/30* (2006.01)
*H05B 33/08* (2006.01)

(52) U.S. Cl.
CPC ..... *H05B 33/08* (2013.01)

(58) Field of Classification Search
USPC ..... 345/77, 82, 212, 76, 80, 204, 690; 362/641; 348/36; 359/463
See application file for complete search history.

(56) References Cited

U.S. PATENT DOCUMENTS

| | | | | |
|---|---|---|---|---|
| 2009/0219234 | A1* | 9/2009 | Yamamoto et al. | 345/80 |
| 2011/0063276 | A1* | 3/2011 | Tan et al. | 345/212 |
| 2011/0069094 | A1* | 3/2011 | Knapp | 345/690 |
| 2012/0099193 | A1* | 4/2012 | Yang et al. | 359/463 |
| 2012/0299979 | A1* | 11/2012 | Murai et al. | 345/690 |
| 2013/0063550 | A1* | 3/2013 | Ritchey et al. | 348/36 |
| 2013/0328754 | A1* | 12/2013 | Lai | 345/82 |
| 2014/0139498 | A1* | 5/2014 | Hussain et al. | 345/204 |

* cited by examiner

*Primary Examiner* — Thuy Pardo
(74) *Attorney, Agent, or Firm* — Bacon & Thomas, PLLC

(57) ABSTRACT

The Multiple Display-units LED light device has special light effects which means the more than one of display-unit can be assembly into one viewing product install within the base by certain strength or assembly means which has the prong means or other unlimited power source mans to supply the electric signal to the said LEDs to make the eye-catching light effects. The display unit may have the build-in input-end or separated input-end to allow to match the said receptacle means of the base. The base with LED related circuit, prong means and other control means, IC means may disposed into the base or incorporated with sealed-unit to make the light beam to be seen by viewer though the viewing area for dedicated art, word, signal, data, design, motion liquid, 3 dimensional, geometric design, art, digital data, liquid crystal screen, LCD and colored image with color change LEDs for illumination.

17 Claims, 11 Drawing Sheets

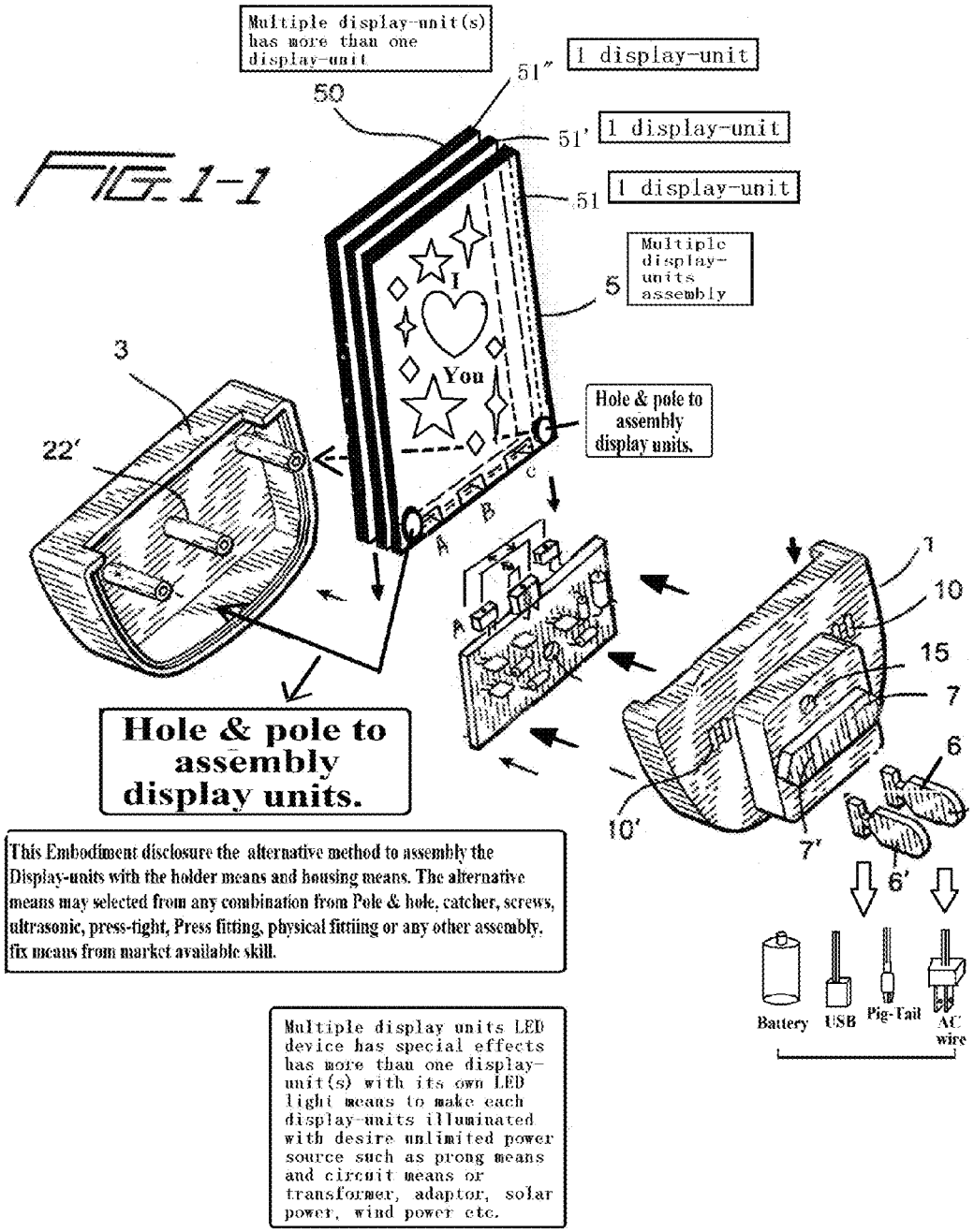
FIG. 1-1
Multiple display-unit(s) has more than one display-unit
1 display-unit
1 display-unit
1 display-unit
50
51"
51'
51
5
Multiple display-units assembly
3
22'
You
Hole & pole to assembly display units.
Hole & pole to assembly display units.
1
10
15
7
6
10'
7'
6'
Battery
USB
Pig-Tail
AC wire
This Embodiment disclosure the alternative method to assembly the Display-units with the holder means and housing means. The alternative means may selected from any combination from Pole & hole, catcher, screws, ultrasonic, press-tight, Press fitting, physical fittiing or any other assembly, fix means from market available skill.
Multiple display units LED device has special effects has more than one display-unit(s) with its own LED light means to make each display-units illuminated with desire unlimited power source such as prong means and circuit means or transformer, adaptor, solar power, wind power etc.

Fig 5
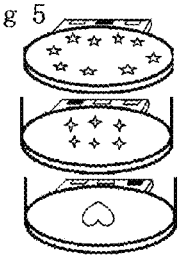
Fig 5-1
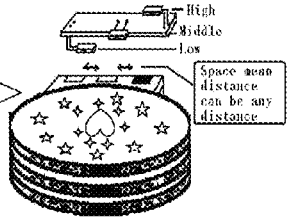
Fig 5-2
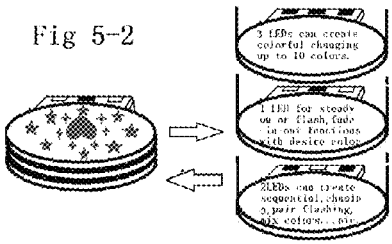
Fig 5-3
Fig 6
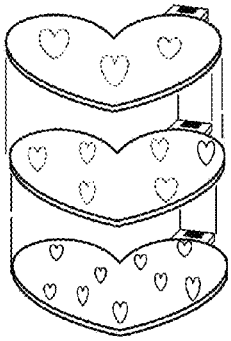
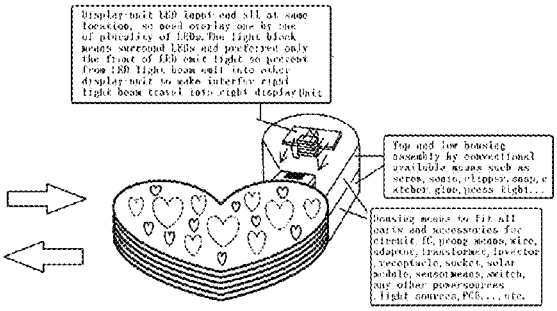
Fig 6-1

Mulitiple Display-units for current invention for non-portable device. It cover for 1. Plug-in device by prong -means 2. Desk top or any surface installation by batteries, adaptor, transformer, USB power, computer power, solar power 3. It also can be good for the outdoor activities such as festival, camping.

MULTIPLE DISPLAY-UNITS LED LIGHT DEVICE HAS SPECIAL LIGHT EFFECTS

This application is a continuation of U.S. patent application Ser. No. 11/527,629, filed Sep. 27, 2006, now U.S. Pat. No. 8,545,090.

BACKGROUND OF THE INVENTION

The current invention is an LED light device having multiple display units capable of providing special lighting effects. Each display-unit has its own LED or LEDs to illuminate the display-unit and create a light show, with effects that may include steady-on, chasing, random, fade-in and fade-out, sequential, pair flashing, or any other LED or light functions. Control of the light functions may be provide by IC means, sensor means, remote control means, PIR means, heat means, and/or Bluetooth means. The LED device can use any unlimited power source and is not limited to a plug-in night light, so long as the unlimited power source enables the LED device to be used without replacing the energy source for a certain period of time. Suitable unlimited power sources include wall outlets, rechargeable batteries, sources of solar power, wind power, chemical power, water power, or biologic power, or other equivalent power sources.

The invention preferably utilizes small non-portable power sources. Because the LED light device is not for people to wear or to bring on the body but rather has a high power consumption due to the plurality of LEDs used in the light show, use of portable power sources would necessitate frequent replacement of the batteries or the use of very expensive thin batteries such as CR 2030 or CR2032. As a result, the current invention does not cover a portable LED light device which has a short life and expensive batteries. Instead, a battery for the current invention should have a capacity of 500 ma and be relatively inexpensive, as is the case with a carbon or alkaline battery ranging in size from AAA, AA, Sub C, C, or larger, thereby providing long life, cheap cost applications for desk top, camping, garden, festival, and holiday use. Other power sources can include green energy sources such as solar power, as well as chemical power, biologic power, food power, computer power from a USB means, AC wire means, and/or power supplied through a transformer, adaptor, invertor with proper adaptor, plug, receptacle, socket, or other plug-receiving means connected to a preferred power source.

The multiple-display-unit LED light device with special lighting effects described herein differs from light devices described in other copending applications of the inventor in that it includes one or more of the following extra features:

1. The multiple-display-unit LED light device with special lighting effects has more than one display unit and each display unit has its own art, design, character, word, logo, sign, geometric shape, color, painting, silkscreen, optics means, light passing-through means, semi-transparent means, block-out means, transparent means, plastic resin, air bubble, cut-out, opening, windows, colors, characters, cartoon figure, holiday art, seasonal signals, greeting words, commercial advertisement, promotion words, time, digital data display, LCD display screen, monitor screen, sign, or any message that can be seen by viewers.
2. The multiple-display-unit LED light device with special light effects has at least one light blocking means made of a desired material and having a preferred shape, construction, and/or design to block out LED light beams to and prevent interference of the LED light beams with another display unit. The light blocking means may take the form of a metalized sheet or a piece or unit made of plastic, paper, wood, or another material so long as the LED light beams cannot pass though the block-means to interfere with the illumination provided by another display-unit.
3. The multiple-display-unit LED light device with special lighting effects has at least one power source that limits portability or walking with the LED light device, such as 1. plug-in by prong means to obtain home electricity or 2. power from a USB port, computer, laptop, transformer, adaptor, invertor, charger, USB charger, solar power, or chemical power, the LED light device being consequently suitable for surface installation including on a desk top, table, wall, or floor for indoor or outdoor use, the LED light device being especially suitable for outdoor holiday, seasonal, or festival applications which can utilize all art, design, drawing, painting, 3D-engraving, cartoon, character, or religious symbol, etc., to provide exciting LED light effects, functions, and/or performance including color changing, motion, moving messages, images, and signals to be seen by a viewer.
4. The multiple-display-unit LED light device with special lighting effects has at least one means for delivering a power signal to the LEDs, which may for example include the various power signal delivery means disclosed in the inventor's U.S. Pat. No. 8,303,150, such as a prong means, socket means, AC outlet means, pig-tail wire sets, adaptor plug, plug and receptacle means, socket means, quick connect means, plug and socket means, USB plug and port means, or any other electric signal delivery means.
5. The multiple-display-unit LED light device with special lighting effects may take the form of a plug-in night light, table or desktop LED light, wall-mounted LED light, sign, commercial light box, evacuation sign, advertisement sign, analog time piece, desk top lamp, clock, light tube, toy, projection light, mobile phone surface panel, communication device, computer device, or consumer electric device, preferably in an application that does not require portability so that the power can last a longer time by being connected to an unlimited power source, energy storage power source, transformer, adaptor, invertor or computer device's USB power outlet.
6. The multiple-display-unit LED light device with special lighting effects has at least one single or multiple color LED light means that fits within each display unit at an LED input end so that light from the LED light means passes through an optics-means and so that art, words, a geometric shape, messages, data, a digital data display, an LED display screen, or a monitor screen of the display unit as listed in item (1) above is illuminated to be seen by viewers.
7. The multiple-display-unit LED light device with special lighting effects has at least one combination of LED light performance, functions, or effects applied to more than one display unit, the performance, function or effects being selected from steady-on, flashing, sequential, chasing, random, fade-in and fade-out, pair flashing, or a desired combination of multiple pair flashing.
8. The multiple-display-unit LED light device with special light effects has at least one integrated circuit (IC) incorporated with the LED light means to provide a light show as described in item (3) above not only for each display-unit but also for all display-units.
9. The multiple-display-unit LED light device with special light effects includes at least one optics means incorporated with each of the multiple display-units and selected from light passing-though means, light reflective means, light deviation means, retro-reflection means, light refraction means, interface means, convex lens means, concave lens means. focus means, superposition and interference means, diffraction means, optical resolution means, dispersion means, scattering means, and polarization means so as to create more eye-catching light effects while applying the desired optics means to the current invention.

10. The multiple-display-unit LED light device with special light effects has at least one switch means to turn on and turn off the LED device, which may be selected from sensor means, remote control means, magnetic means, motion sensor means, timer means, heater means, moisture means, flood means, photo sensor means, Bluetooth means, a sound activation switch, and/or WiFi or Internet signal transmitter and receiver means.
11. The multiple-display-unit LED light device with special light effects has at least one circuit or transformer, adaptor, inverter, or other electric parts and accessories that can change any power source electric signal into electric power for the IC means and other LED-related parts and accessories.
12. The multiple-display-unit LED light device with special light effects has at least one space divider means to ensure proper spacing between each display-unit's LED with respect to the horizontal or vertical axis of a three-dimensional coordinate system to prevent the LED light beams from the respective display-units from interfering with each other, or disturbing or being emitted into other display units.
13. The display unit of the multiple-display-unit LED light device with special light effects has a curve shape or any geometric shape in two or three dimensions with carvings, engraving, painting, laser engraving, or laser carving to provide a two or three dimensional image that can be seen by viewers.
14. The multiple-display-unit LED light device with special light effects includes a space for at least one filler selected from a liquid, chemical compound, miniature objects, floating stuff, reflective pieces, liquids of different density, a printed background, a screen, and any combination of said fillers.
15. The multiple-display-unit LED light device with special light effects has at least one housing means in which is arranged all of the parts and accessories, including fastening means, assembly means, catch means, holding means, fixing means, screws, ultrasonic sealing means, multiple display units, IC means, switch means, LED related parts and accessories, prong means. circuit means, conductive means, transformer means, adaptor means, socket means, receptacle means, a receiving-end, a printed circuit board, sensor means, photo sensor means, remote control means, receiver means, Bluetooth means, or any other related means to cause the multiple-display-unit LED light device with special light effects n to work properly when put within the housing.
16. The current invention has very exciting motion effects, including changeable colors, changeable messages, and/or other moving effects provided by the multiple display units, unlike the single displays described in copending applications, which merely allow the light beams to be seen and which are not exciting for people or kids.

Additional features that may be utilized in the current are disclosed in other U.S. patent applications of the inventor, including the following: 1. Ser. No. 10/954,189 for "An electro-luminescent (EL) illuminated wall plate device with push-tighten frame means," filed Oct. 1, 2004;

2. Ser. No. 11/094,155 for "Multiple function wall cover plate," filed on Mar. 31, 2005;

3. Ser. No. 11/094,156 for "Multiple functions night light," filed on Mar. 31, 2005;

4. Ser. No. 10/667,787 for "Multiple lit-area(s) of Electro-Luminescent element(s) arrangement";

5. Ser. No. 10/286,871 for "A tubular Electro-Luminescent light device";

6. Ser. No. 10/621,513 for "Environment proof treatment for Electro-Luminescent (EL) element(s)";

7. Ser. No. 11/094,215 for "LED night light with liquid arrangement," filed on Mar. 31, 2005;

8. Ser. No. 11/255,981 for "Night light with 2 light source," filed on Oct. 24, 2005;

9. Ser. No. for "Time piece with LED light means, filed on Nov. 21, 2008;

10. Ser. No. for "Multiple function LED night light with Air Freshener", filed on Sep. 27, 2006

In addition to the features 1-16 described above, the present invention may utilize a feature adapted from the devices described in the above-cited prior applications of the inventor, in which the display units of the LED night light are made interchangeable to offer a very safe design prevents people from being exposed to prong means and receiving an electric shock. The design of the interchangeable display units enables each display unit to be separated when subjected to a certain pulling, pushing, twisting, kicking, dropping, or other impact strength so that the force applied to the prong means will be reduced because the display unit has already separated from the base and because the torque is minimized as a result of the reduced the distance, so as to prevent harm to the base's prong mean. This will keep the prong means safe under any potential impact strength that might be applied to the night light.

Another feature adapted from the devices described in the inventor's prior applications is to include a sealed unit that seals all components in contact with live wires, which have a very high voltage at a frequency that may cause people great harm, the sealed unit ensuring that all components are sealed within a most safe case that prevents people from touching these dangerous parts under any condition. For example, the sealed-unit may seal the LED circuit, prong means, control means, and related parts, all of which are disposed within a case made of a qualified safety material to form a sealed-unit that meets all required safety standards, so that all other housing parts can use any material without limitation because the only material that touches the live wire is the qualified safety material.

A third feature adapted from the devices disclosed in the inventor's prior applications is to provide a display area and display input-ends for quick installation so as to enabling selection of the most eye-catching light effects created by different display area designs, including: (1) the display area having certain treatments selected from opening(s), cut-out(s), hole(s) on its surface to provide the desired light effects and performance, or (2) the display area having space to load a liquid, chemical compound, miniatures, floating stuff, reflective piece(s), different density liquids, a printed background, a screen, or any desired combination of the foregoing items, or (3) the display area having a curved egg-shell shape with a negative or positive engraving process applied to cause the inner surface to be three dimensional with sufficient depth to cause a design, artwork character, drawing, or cartoon to look alive.

A fourth feature adapted from the devices disclosed in the inventor's prior applications is provide the display unit with a display area and a separate display input-end, and a night light base with at least one prong means to connect with a power source and one receptacle means to receive the display input-end. The LED light means is connected with a related circuit, control means, and the prong means to enable the LED to be turned on with predetermined functions and timing. The adaptations include that the receptacle means is built into the base as one piece so that the receptacle means keeps people from touching the live wires and components while receiving the display input-end. The display input-end connects with the receptacle means to get light, heat, or desired physical phenomenon from the said base inner electric device. The display area may again have a geometric shape with space to load a liquid, chemical compound, miniatures, floating stuff, reflective pieces, liquids having a variety of densities, a printed background, a screen, a solid plastic resin with geometric air bubbles inside, or any desired combination of the foregoing items. These features will result in a night light that is very safe and yet has splendid light effects.

adapted from the devices disclosed in the inventor's prior patent applications is that the display unit may be selected from any combination of a liquid filled unit, a solid plastic unit with air bubbles within, a solid plastic unit with laser engraving within, a curved plastic piece with three dimensional engraving art, and a plastic piece with cut-out(s) or equivalent treatments. The display area has a geometric shape with space to load a liquid, chemical compound, miniatures, floating stuff, reflective piece(s), liquids with a variety of densities, a printed background, a screen, a solid plastic resin with geometric air bubbles inside, or any desired combination of the listed items to achieve splendid light effects.

A detailed description of preferred embodiments will now be provided with reference to the drawings.

BRIEF DESCRIPTION OF THE DRAWINGS

FIG. 1-1 is a perspective view of a multiple-display-unit LED light device with special light effects, in which the multiple display-units are assembled together by an alternative method without a receptacle means, instead using a screw(s), hole and pole, catch, ultrasonic weld, glue, chemical compound, hooks, rivets or any other fixing or assembly means to enable the multiple display-units to be installed within a holder or housing.

FIGS. 2-4, 5, 5-1, 5-2, 5-3, 6, and 6-1 are perspective view of the display units of different preferred embodiments of the multiple-display-unit LED device with special light effects, each of the embodiments including LEDs and multiple display-units with art, windows, painting, a screen, optics means, and/or an LCD image to show the viewer while the LEDs turn on and turn off according to predetermined functions to show a message, data, or signals on the different display-units, the display-units further including two or three-dimensional displays with blocking of spacing means that prevent the LED light beams from being emitted into that wrong display-units and thereby interfere with the corresponding light effects, functions, and performance.

DETAILED DESCRIPTION OF THE PREFERRED EMBODIMENTS

Figure 14:
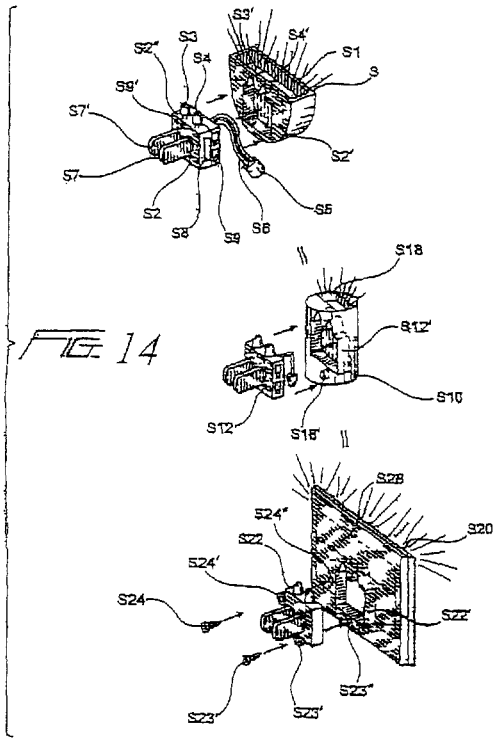

The multiple-display-unit LED device with special light effects as disclosed herein may utilize display unit designs that are similar to those illustrated in FIGS. 14-18 which show display-units that are also disclosed in parent U.S. patent application Ser. No. 11/527,629, filed on Sep. 27, 2006. each display-unit having its own LED(s) to provide colorful lighting effects under control of an IC and circuitry that causes the different display-unit(s) to exhibit motion effects, color changing, images, messages, logos, words, and/or changeable screens to viewers. FIG. 14 shows a sealed-unit construction that provides a universal model arranged to fit all kinds of night light devices.

FIG. S shows a universal sealed-unit (S2) (S12) (S22) with pre-designed openings (S2') (S12') (S22') to allow the universal sealed-unit (S2) (S12) (S22) to fit into an opening (S2') (S12') (S22') in a base (S1) (S10) (S20) of the LED light device. Any conventional fastening method can be used to fasten the sealed-unit (S2) (S12) (S22) to the base or housing part (S1) (S10) (S20), including screws (S23) (S24), welding, sonic sealing, glue, solvents, rivets, catches, or equivalent fixing means. The sealed-unit (S2) (S12) (S22) is preferably made of plastic with a certain thickness to pass the 94-V-0 flammable grade safety standard while the base or housing part (S1) (S10) (S20) can be made of any material without any limitation because it does not touch live wires, which are all contained in the sealed-unit (S2) (S12) (S22). The base or housing part (S1) (S10) (S20) can be any shape, configuration, design, curvature, thickness, material, and dimension, with built-in or separate receptacle means. The sealed-unit may contain LED-related circuitry, control means, and prong means disposed within, and can be designed to provide a super slim and wider unit or a thicker and smaller unit depending on market requirements. For example, the base or housing unit can have a boat shape (S1), tube shape (S10), or rectangular shape (S20) for different night light applications.

The boat-shaped base (S1) has an opening (S2') having a same shape as the sealed-unit (S2). The sealed-unit (S2) has an LED-related circuit (S8) and its components (S9), and prong means (S7) (S7'), all of which are sealed within the case (S2). The top of the case has two LEDs (S3) (S4) which are connected with the inner circuit (S8), but all of the LEDs' electric legs are sealed within the case and cannot be touched by test equipment, to make sure the kid's finger will not touch these live wires to cause a dangerous condition. The LED (S5) uses conductive wires (S6) to enable it to be pulled far away from the unit's housing (S2) for other illumination arrangements.

The LEDs (S3) (S4) also fit into the base opening (S3') (S4') and a wall (S2") will cover the LEDs after assembly with the base housing. After the assembly, The LED light beams can pass through the base's opening area (S) to provide good light effects to the upper display unit.

The tube-shaped base (S10) also has an opening (S12') to allow the sealed-unit (S12) to fit into the opening with two or more LEDs at desired positions and orientations and a wiring arrangement, the base (S10) being arranged to allow light beams to be emitted out from the base top opening (S18) and lower window (S18') for desired illumination.

The rectangular base (S20) is especially for a surface lighting arrangement. The LED spot light beams pass through a light-medium (S28) to allow the LED light beam to travel within the light-medium (S28) and a majority of light beam to be seen by the viewer from the light-medium's (S28) surface. The viewer will not see any hot spot of LED light brightness but rather will see a very soft and even photometric area light for special illumination. The Rectangular base (S20) has an opening (S22') to allow the sealed-unit (S22) to fit tightly and optionally be fixed in the rectangular housing (S20) with glue or solvent or other adhesive means, sonic means, welding means, catch means, or hook means. The LED will fit into the light-medium's thickness to get the best result.

Figure 15:
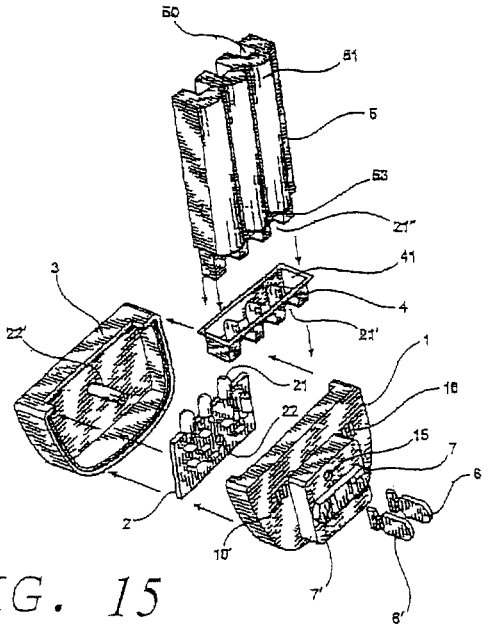
FIGS. 14-18 show LED devices of the type described in the inventor's parent U.S. patent application Ser. No. 11/527,629, filed Sep. 27, 2006, and issued on May 24, 2013.

FIG. 15 shows an LED night light with an interchangeable display unit (5) that can be separated from the base (1) when a certain pulling, twisting, pushing, or other force is applied to the night light without any tools. This feature will reduce the pulling weight applied to top of the display unit (5) to prevent a big torque from being applied to the base back area causing the base to break and expose the prong means (6) (6') to air and present a risk of electric shock.

The back base (1) has holes (7) (7') to allow the prong means (6) (6') to pass through and be soldered to an inner printed circuit board (PCB) and deliver power to the PCB (2) to drive all LED-related circuit (a variety items on the drawing) according to predetermined functions, timing, and control. The PCB has a hole (22) that can allow the front base (3) central pole to pass through and allow a screw (not shown) to be applied to the back base's hole (15) to fasten the two base halves together and capture the PCB (2) and receptacle means (4) within.

The receptacle means (4) have a variety of openings, cutouts, or equivalent windows to allow the LEDs (21) to be installed at a respective desired position (21') enable the light beams emitted by the LEDs to pass toward the display input-end (21") of the display unit (5) for desired illumination. The same arrangement is applied to the other two LEDs to align with respect to the receptacle's openings and toward the display's input-ends. The display unit (5) has a display area (50) (S1) for light performance and display input-ends (21") for get light beams into the display unit (5).

Figure 16:
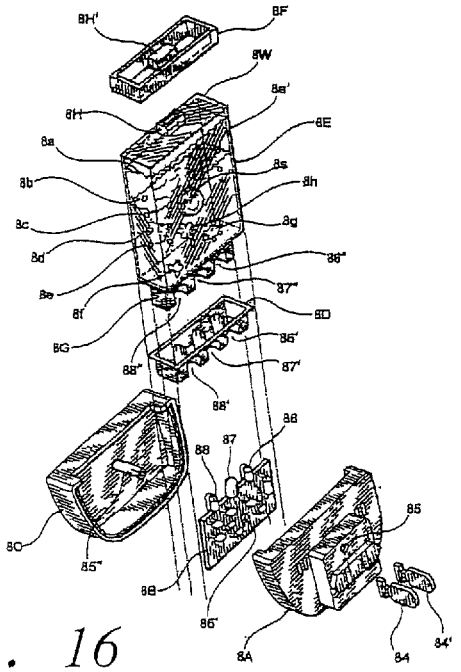

FIG. 16 shows a special design for a display area (8E). The display area (8E) has a geometric shape with space to load a liquid (8*a*), chemical compound (8 *a'*), miniatures (8*f*) (8*g*), floating stuff (8 *s*), reflective pieces (8 *b*) (8 *c*) (8 *d*) (8 *e*), a variety of different density liquids (8*a*) (8*a'*), a printed background on a back of housing (8W), a screen (not shown), a solid plastic resin with a geometric air bubble inside (not shown), or any desired combination of the foregoing items within the space in display area 8E. The display unit has a top area which is a raised portion (8H) to allow air-space so that the liquid can move when heat is applied from a heat-element (86) (88) on the display input-ends (86") (87") and through the receptacle means opening (86') (87'), which can deliver the heat-element temperature to the display input-ends and cause the display inner chemical to become a moving flow and cause all reflectors suspended therein to move. This is a very nice effect. The LED (87) can offer different light effects selected from steady on, chasing (for example, while utilizing a three-color LED), random, pair flashing, color changing, or any conventional light effects.

The raised portion (8H) needs a cosmetic cover (8F) to allow the raised portion (8H) to fit within the space (8H') and provide a nice viewing appearance.

The front (8*c*) and back base (8A) are sealed by fastening means or screws as discussed above in connection with FIG. S1.

As shown in FIG. 15, the display unit (5), base (1) (3), or sealed unit (FIG. 14) material can be wood, pottery, porcelain, metal, bamboo, poly, plastic resin, paper, textile, woven, or any other material available from the marketplace.

Also as shown in FIG. 15, the display area may have a certain treatment selected from opening(s), cut-out(s), and/or hole(s) on its surface to create desired light effects and performance.

FIGS. 2-9 show nine alternative styles of the preferred display unit, display area, and display input-end.

Figure 17:
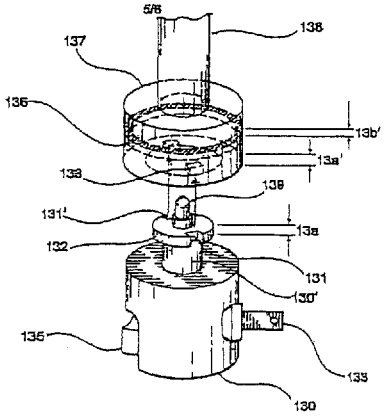

As shown in FIG. 17, the alternative display area (140) may have a curved egg-shell shape (146) (146') with a negative (146'") or positive (146") engraving process applied to cause the inner surface to form a three-dimensional image (144) with sufficient depth (146'") or height (146") to make the design, artwork character, drawing, or cartoons look alive. The side viewing angle and top viewing angle show the very dedicated feature of the current invention. If the design, artwork, characters, drawing, or cartoons are provided with hand-painted colors, the value of the light device will increase.

Figure 18:
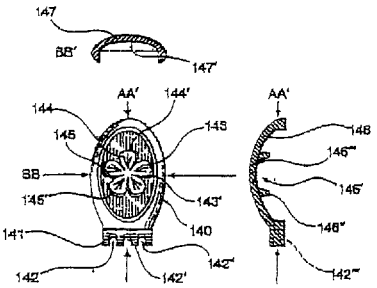

As shown in FIG. 18, the receptacle means (130') may be built-into the base (130). The receptacle means (130') and base (130) are constructed as one piece so that the receptacle means isolates live wires and components from people to prevent touching, and also matches the display input-ends (133) (133') with the corresponding receptacles (131) (131'). The display input-ends (133) (133') connect with the receptacle means (131) (131') to provide power for the light (139), heat (not shown), or desired physical phenomenon from electrical circuitry in the base (130) (not shown). The display area (138) has a geometric shape with space to load a liquid, chemical compound, miniatures, floating stuff, reflective pieces, liquids having a variety of densities of liquid, a printed background, a screen, a solid plastic resin with geometric air bubbles inside (138), or any desired combination of listed items within the space. The container 8E of the display shown in FIG. 16, also have any of these materials inside. The display unit (138) of FIG. 18 is inserted into the hole of input-end (137) by a temporary fix which can be separated by a pulling, pushing, twisting force to enable the display unit to separate from the input-end to enhance safety. As shown in FIG. 18, the base with LED (139) is on top of the receptacle means (132). The two cutouts (131) (131') allow the two posts (133) (133') to pass through the two cutouts (131) (131') of the ring (132) so that the two posts (133) (133') of the display input-end (137) can be pushed down to a lower level of the said ring (132) and the display input-end housing (137)

twisted to cause the two posts (133) (133') to be tightly held by the portion of ring (132) without the cutouts (131) (131'). This is an alternative embodiment which is equivalent in function with the embodiments of FIGS. 15, 16, and 17 but with deviations, changes, and/or improvements that still fall within the spirit of the current invention.

It will be appreciated that the above-discussed single-display-unit embodiments, which are also disclosed in the parent application (as well as the multiple-display-unit embodiments described below) are not limited to details of the display units discussed above. Any equivalent function, replacement, alternative process, treatments, experiments, and arrangements may still be within the scope of the current invention. In the following description of the multiple-display-unit embodiments, parts that correspond to the single-display unit embodiments discussed above have the same reference numbers and the descriptions thereof are only repeated to the extent necessary to understand their inclusion in the multiple-display unit embodiments.

Figure 1:
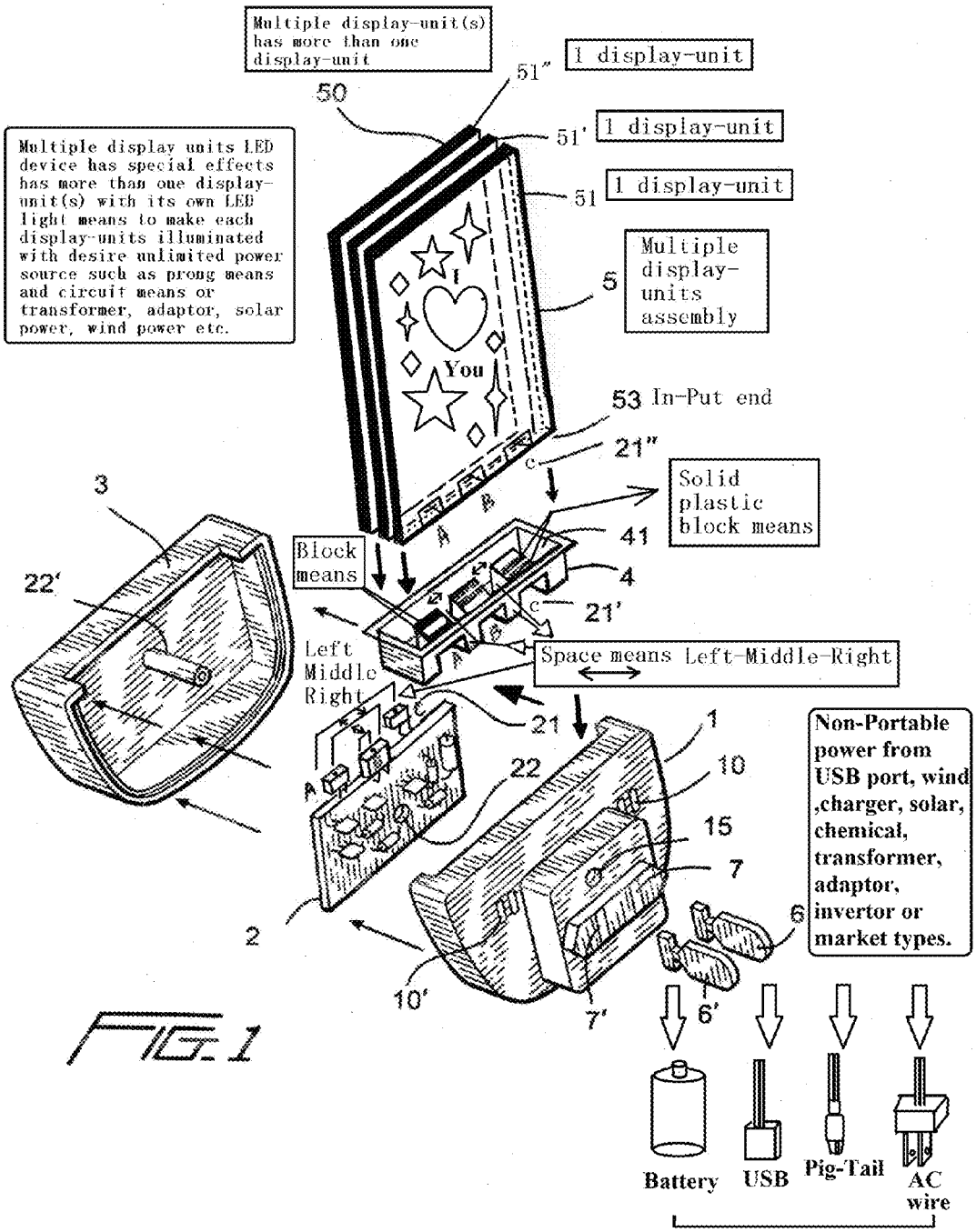
FIG. 1 is a perspective view of a first preferred embodiment of an LED night light with multiple display-units having a plurality of art, designs, geometric shapes, signs, logos, words, messages, and/or digital data on each of the display-units, which are illuminated by LEDs for exciting light effects.

Turning to the multiple-display-unit embodiment of FIG. 1, three display-unit(s) (51) (51') (51") are provided, each one having a different optics means treatment, which may be a silkscreen, painting, texture, or sprayed on layer, and a desired color(s). The three display units are assembled together by the receptacle means (4) for a press tight or physical fitting into the receptacle. The receptacle means (4) has several channels (A) (B) (C) to allow fitting of the LEDs. The channel (A) has an opening at the center of the top of the channel to position the LED light beam to enter the display unit (51') for illumination. Channel B has a right-side opening to allow light to hit its display-unit (51). Channel C has a left-side opening to allow a corresponding LED light beam to enter the display unit (51").

Each LED may have multiple color units and be installed on the PCB with a proper spacer-means to prevent the LEDs from interfering with each other by emitting light beams into other display-unit(s). The bi-directional arrows indicate the spacing arrangement for the preferred embodiment. The spacing means can be at any distance and may even overlay each other as in the embodiments of FIG. 5-2 and FIG. 6. All LEDs are at the same position as each of the display-units, so the LEDs overlay the top, middle, and lower positions to fit into the display-unit's input end. However, each LED may also have its own light blocking means to separate the plurality of LEDs since the light beams will still come out from the four sides of the LEDs and the rear end and preferably need to be prevented from passing to other display-units. The light blocking means may each be a solid plastic unit or sheet or sticker with an opaque material to block all four sides and the rear end of the LED from leaking light beams into the other display-unit(s). The illustrated spacer means and blocking means especially useful for the current invention. However, any alternative or equivalent light blocking skill or method may still fall within the current invention if it prevents an LED's light beams from being emitted to the other display-unit(s).

The receptacle means is optional. It offers a way for the factory to save time by providing a universal base or holder for different display-unit designs having a uniform configuration, size, thickness, width, and depth for insertion of the display unit's input-end. However, to reduce costs, the receptacle means can be eliminated and a holder or housing arranged to directly hold the multiple display-units, as illustrated in FIG. 1-1, by just using traditional holes in the display unit and corresponding posts extending from the holder or housing, or by using other available skills such as fixing means, assembly means, hooks, catches, glue, sonic sealing, rivets, and/or screws to fasten the multiple display-unit(s). Again, each LED(s) for the display-unit input end will still need proper blocking means and spacer means to ensure that the LEDs' light beams will be accurately emitted into the right display-unit.

As shown in FIGS. 1 and 1-1 and all following drawings, the LEDs (A) (B) (C) are located on the PCB (2) which has a proper spacing arrangement such as the one shown in FIG. 1. The LED (A) on the middle position of the PCB illuminates the display (51'), The LED (B) installed on the right side of the PCB illuminates the right-side display unit (51). The LED (C) installed on the left side of the PCB illuminates the left-side display unit (51"). These proper spacer means help the LEDs to fit at the right position and emit light into the display unit though the display area optics treatments to provide eye-catching effects.

The PCB has a power source input end which can use a desired delivery means to deliver power from a preferred non-portable power source such as a home AC outlet via prong means, USB means from a computer, charger, or transformer, an adaptor, an inverter means, or a socket and plug set to that obtains the power from an energy generator or storage device, The non-portable power source can use any desired conductive means to deliver power into a circuit, including the above-mentioned prong means, plug and receptacle, AC wire, USB wire, conductive means, pig-tail, wire device, and/or conductive piece, as illustrated in FIGS. 1 and 1-1.

Figure 3:
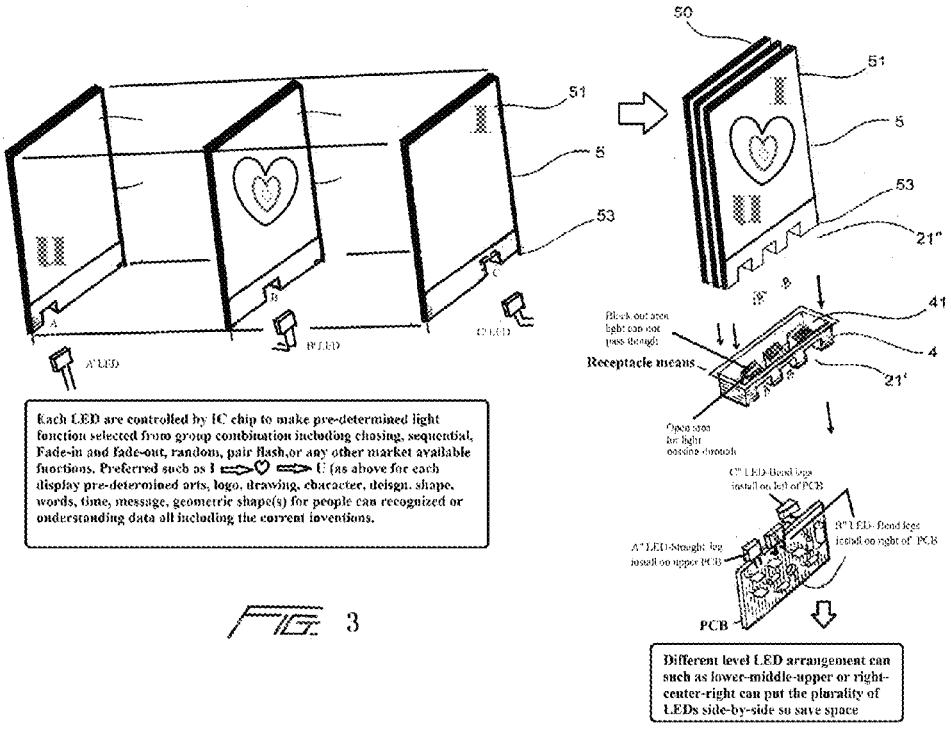

The circuitry into which the non-portable power source delivers the power may incorporate an integrated circuit (IC) so as to cause the LED or LEDs to provide a desired light show by turning on and turning off a respective LED or LEDs for predetermined periods of time to create functions that may include any combination of steady-on, chasing, random, sequential, fade-in and fade-out, pair flashing, changing color, automatically changing color, freezing of one selected color upon color changing, or any other available LED light functions. The LED or LEDs can include more than one piece for each display unit such as is illustrated in FIG. 5-3 to provide the indicated special effects.

The various non-portable power sources shown in FIGS. 1 and 1-1, including the prong means, AC wire means, pigtail means, USB wire means, and relatively large batteries, are all good for the current invention because the current invention is especially adapted to be used in a variety of light devices that are not normally moved during use, such as a plug-in night light, table desk LED light, wall mounted LED light, sign, commercial light box, evacuation sign, advertisement sign, analog time piece, desk top lamp, clock, light tube, toy, projection light, mobile phone surface panel, communication device, computer device, consumer electric device. When these light devices utilize a non-portable power source, the power can last a longer time. Any such non-portable power source or energy storage power source, transformer, adaptor, inverter or computer device's USB power should fall within the scope of the current invention.

As shown in FIG. 1, the holder or housing means (1) and (3) has a built-in assembly means in the form of a screw (15) to fasten the receptacle means (4) and PCB means (2) in the housing means, together with prong means (6) (6'). The receptacle means holds the multiple display-unit(s) in place by a physical fitting or other available skills and methods to provide a perfect LED light device having a motion/moving LED light show from the display area, with a colorful or color changing, moving light show and/or changing images that can exhibit any commercial, advertisement, message, or image presentation to viewers. The light device also can exhibit all kinds of cartoon or character moving effects to provide an exciting light for kids.

As described above, FIG. 1-1 shows an embodiment without any receptacle means to hold the multiple display-units, but that otherwise just uses the holes on the display-unit and posts on the holder or housing means to assemble the PCB, display units, and LEDs within the said holder means or housing means. The rest of the parts and accessories are the same as shown in FIG. 1.

Figure 2:
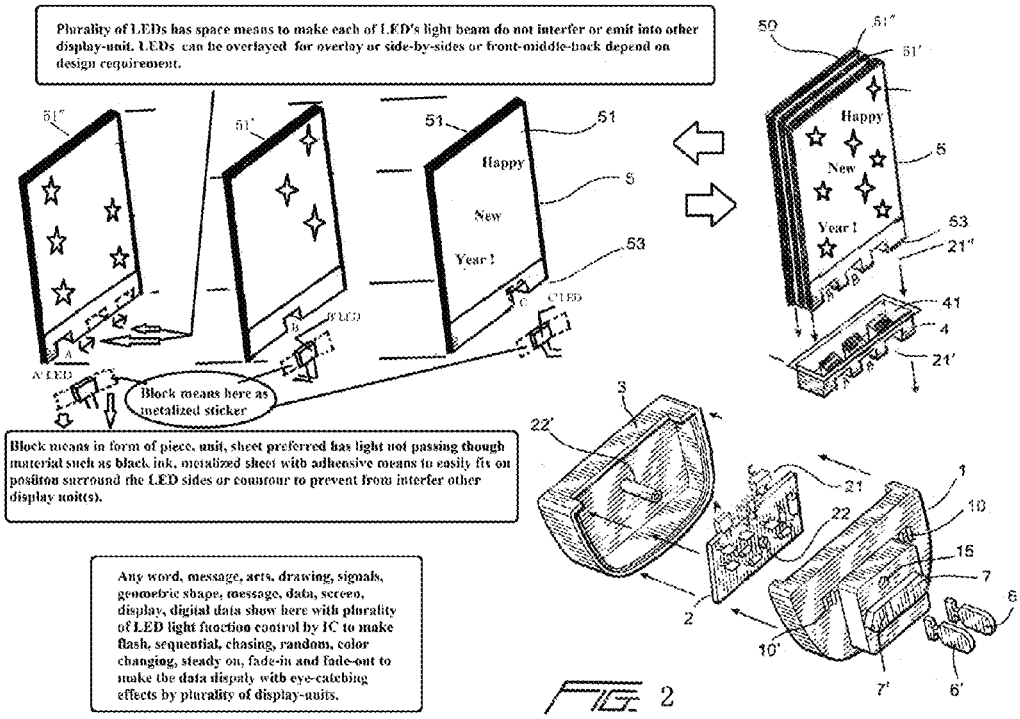

FIGS. 2 and 3 show multiple display unit(s) (51) (51') (51") having display-unit input-ends, each arranged to receive a respective at least one LED (A), (B), or (C). Each display input-end has an opening to allow the LED or LEDs to fit within to allow the LED front light beam to emitted into and travel within the corresponding display-unit. In addition, each LED has a light blocking means for preventing light leakage into other display units.

A preferred light blocking means is a metalized plastic sticker that can easily hold four sides of the LED to block out all 4 sides. As shown in FIG. 2, the assembled multiple of display-units (51) (51') (51") are arranged to fit into the receptacle (41) according to an embodiment of the current invention. The LED has spacer means (A) (B) (C) on the PCB and sticker light blocking means (A'LED) (B'LED) (C'LED) while the receptacle (41) has built-in solid plastic resin blocking means that provides added protection to make sure all LED light beams will be emitted into the correct display unit. This embodiment has prong means to get power from a power source for a plug in type LED light device. The display area for the multiple display units has a holiday greeting or seasonal words (Happy New Year) on the first display-unit (51), stars on the second display unit (51') and stars of Bethlehem on the third display unit. The built-in IC chip will sequentially illuminate the three display units to obtain the following sequence: Happy New Year→stars→stars of Bethlehem, either in a chasing or sequential flashing mode. The color for each display-unit may be printed or sprayed-on color, or different color LEDs may be used to make an eye-catching exciting light performance or effects.

The embodiment shown in FIG. 3 Is the same as that of FIG. 2 but the three display units form the moving message I→LOVE→U with different colors and shapes.

FIGS. 5, 5-1, 5-2, 5-3, 6, and 6-1 multiple-display-unit light devices having various shapes and colorful LED designs to provide special effects for each display unit. For example, red, green, and blue LEDs can be combined in various ways to obtain up to seven colors for each individual display unit or for all display units. FIG. 5 shows three different disc-shaped display units with different LED locations for each display unit so the corresponding circuitry shown in FIG. 5-1 has a simple spacer and light blocking means arrangement. In particular, as shown in FIGS. 5-2, 6, and 6-1, all LED locations for each display unit are at the same relative position so all LEDs overlay other corresponding LEDs in a line to provide very good light blocking because the LEDs in the same line (high-middle-low) allows blocking to be achieved by a simple arrangement of top and bottom reflective and adhesive stickers.

FIG. 6-1 shows a housing means or holder means which fit all display units as well as circuit and non-portable power delivery means, switch means, IC means, and LEDs. The holder means or housing means preferably have as small a size as possible, while being big enough to hold or fit all parts and accessories within. The location can be anywhere as long as the display unit's input-ends, LEDs, and other electrical parts and accessories are inaccessible to a user's touch so that the light device can pass any safety standard.

Figure 7:
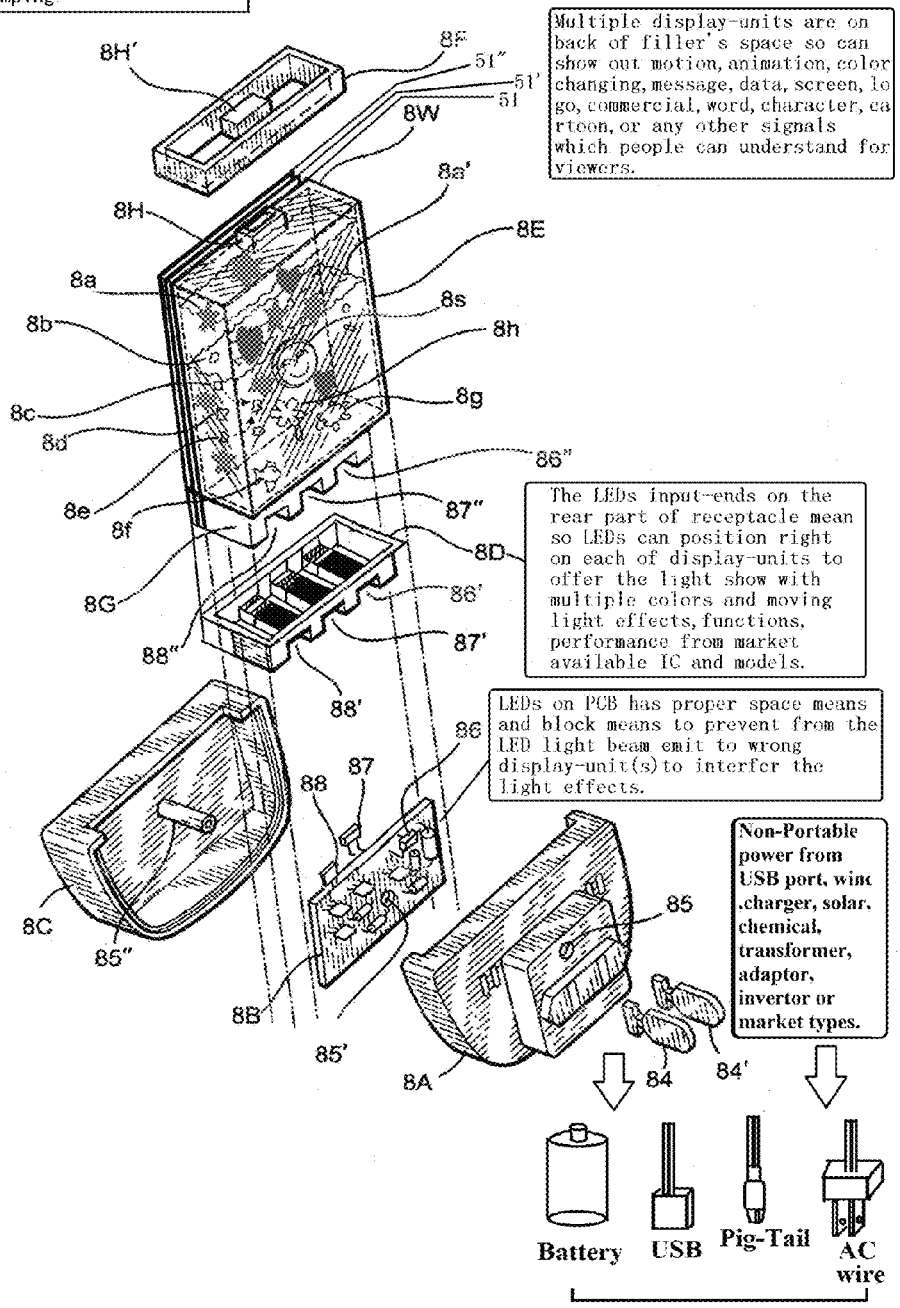
FIG. 7 is a perspective view of another embodiment of a multiple-display-unit LED device with special light effects, the display unit having a space that can be filled up with liquid related items and that further can be incorporated with a heating-element to cause the liquid to be moved.

FIG. 7 shows multiple display-units that are positioned on the back side of a container 8E corresponding to the container 8E described above in connection with FIG. S4, which provides a space for fillers, the display-units being arranged as described above to show, for example, motion, animation, a color changing message, data, a screen, a logo, a commercial, words, characters, cartoons, or any other displays that people can understand. The LED input-ends on the rear parts of the receptacle means enable the LEDs to be correctly positioned on each of the display-units to offer the light show with multiple colors and moving light effects, functions, and/or performance under control of a commercially-available IC or other circuitry.

As shown in FIG. 7, the LEDs are installed on a PCB having proper spacer means and light blocking means to prevent LED light beams from entering the wrong display-unit to interfere with the respective light effects.

A non-portable power source is preferably utilized, which means that the LED light device is not for people to wear or bring on the body because the plurality of LEDs included in the current invention have a relatively large power consumption. If a portable power source such as an expensive thin battery (e.g., a CR 2030 and CR 2032 battery) is used, the battery needs to be replaced very often. As a result, it is preferred not to use such short life and expensive batteries. If a battery is used, it should have a capacity of over 500 ma and a relative cheap cost. Suitable batteries include a carbon battery or alkaline battery having a size of AAA, AA, Sub C, C, or larger for longer life, lower cost application such as non-portable devices used for a desk top, camping, garden, festival, or holiday use. The non-portable power source may advantageously use green energy such as solar power, chemical power, biological power, food power, or power from a computer such as power supplied through USB wires, as well as power from AC wire means, a transformer, an adaptor, inverter means with a proper adaptor, a plug, a receptacle, a socket, a receiving means, or other power delivery means connected to a suitable power source.

As shown in FIG. 7, the multiple display units are on the back of container 8E having a space that may be filled with, for example, a liquid so the light show will pass through the front liquid, resulting in a more splendid and enlarged image or light effects. As described above in connection with FIG. S4, the filler may be selected from the group consisting of a liquid, chemical compound, miniature objects, floating stuff, reflective pieces, liquids of different density, a printed background, a screen, and/or a combination of fillers arranged to glow and be illuminated by the LEDs from the multiple-display-unit LED light device. This will enhance the light effects and can be applied not only to the plug-in LED light device of FIG. 7, but also to a battery-powered desk top device or other indoor LED device with a preferred non-portable power source as described above.

Figure 4:
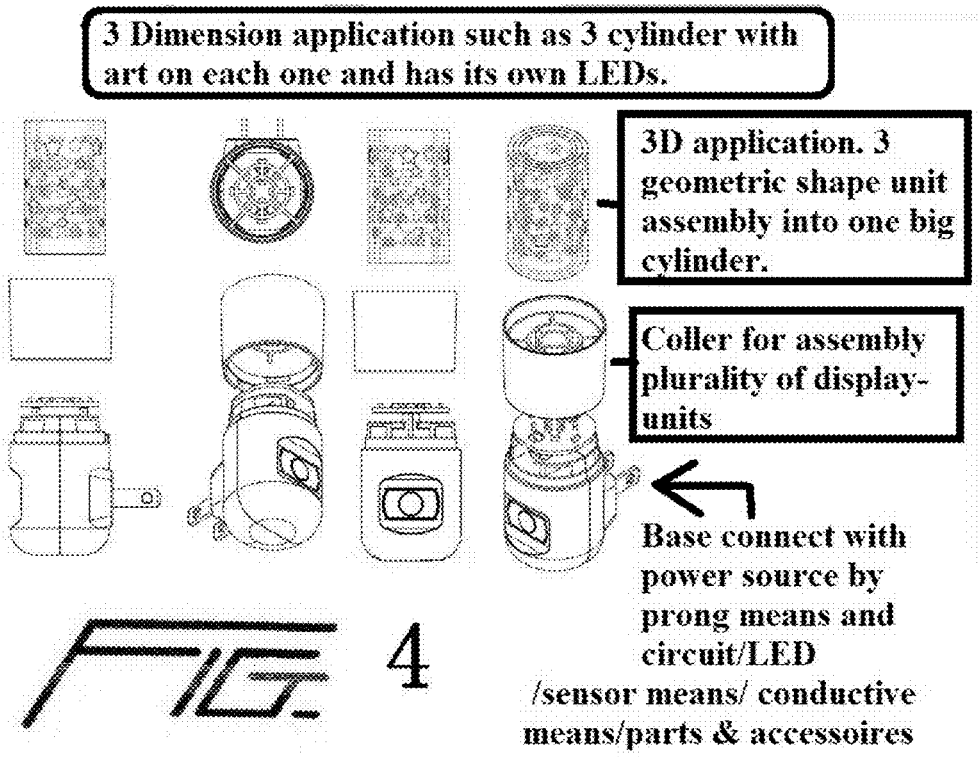
Figure 8:
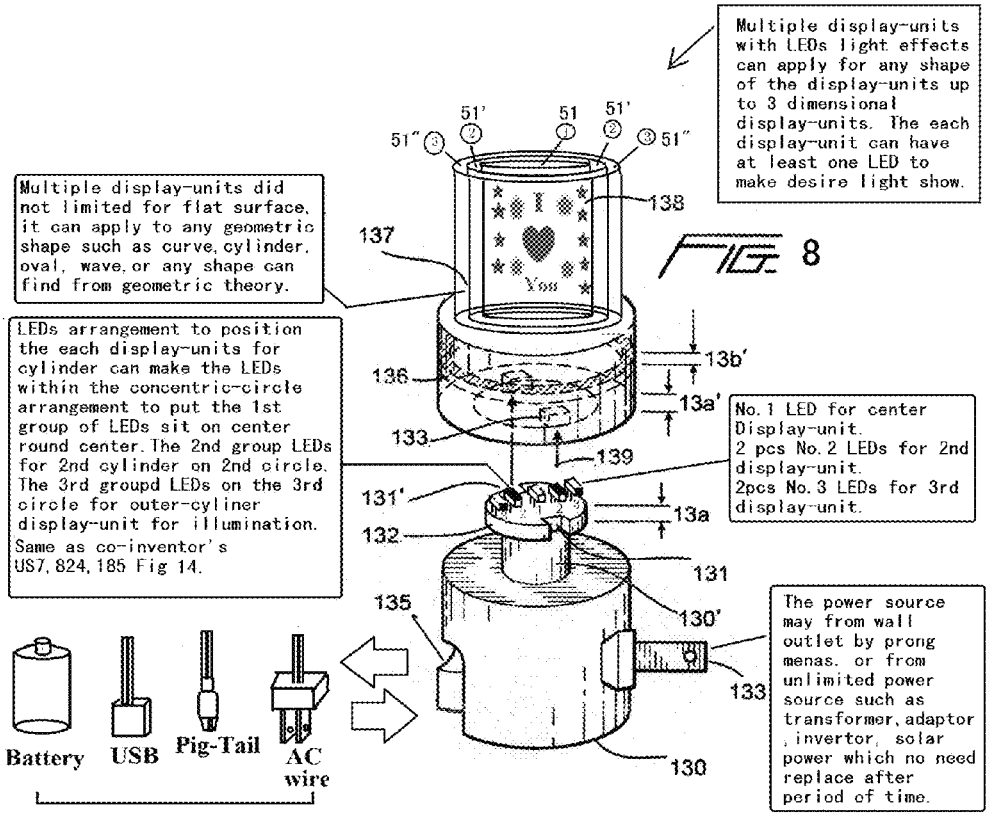
FIG. 8 is a perspective view of another embodiment of a multiple-display-unit LED device with special light effects, the multiple display-units including three different-diameter cylinders, each having its own LED(s) for illumination according to predetermined light functions, effects, and performance, the LED device optionally having prong means to supply electricity to the plug-in type LED device, although it will be appreciated that the LED device is not limited to a plug-in device so long as is a non-portable device because portable devices cannot last as long when using multiple LEDs to provide a light show, the cylindrical display-units further including a tube base with built-in receptacle means to receive separate display input-ends.

FIGS. 4 and 8, show a three-dimensional design which has three cylinder shaped display units, each of which has a display input-end that can be fitted with at least one LED. As shown in FIG. 8, the multiple display-units are not limited to a flat surface, but rather can have any geometric shape such as a curve, cylinder, oval, wave, or any other geometric shape. As illustrated, the display-units and LEDs are arranged within concentric circles arrangement so that the first group of LEDs is at the center, the second group of LEDs for the second cylinder is on a second circle, and the third group of LEDs is on a third circle for the outer-cylinder display unit. The concentric circles are similar to those shown in the inventor's U.S. Pat. No. 7,455,444, although U.S. Pat. No. 7,455,444 does not show multiple display units of the type shown in FIG. 4.

FIG. 8 shows a concentric-circle arrangement for a plurality of LEDs, including an LED (1) for the center circle, two LEDs (2) for the second circle, and two LEDs (3) for the third circle, so that the cylindrical display units glow with very good light effects without any dark areas. The concentric circles are similar to those shown in the inventor's U.S. Pat. No. 7,824,185, although U.S. Pat. No. 7,824,185 does not show multiple display units of the type shown in FIG. 8.

The light device shown in FIG. 8 may use any of a variety of power sources depending on market requirements.

Figure 9:
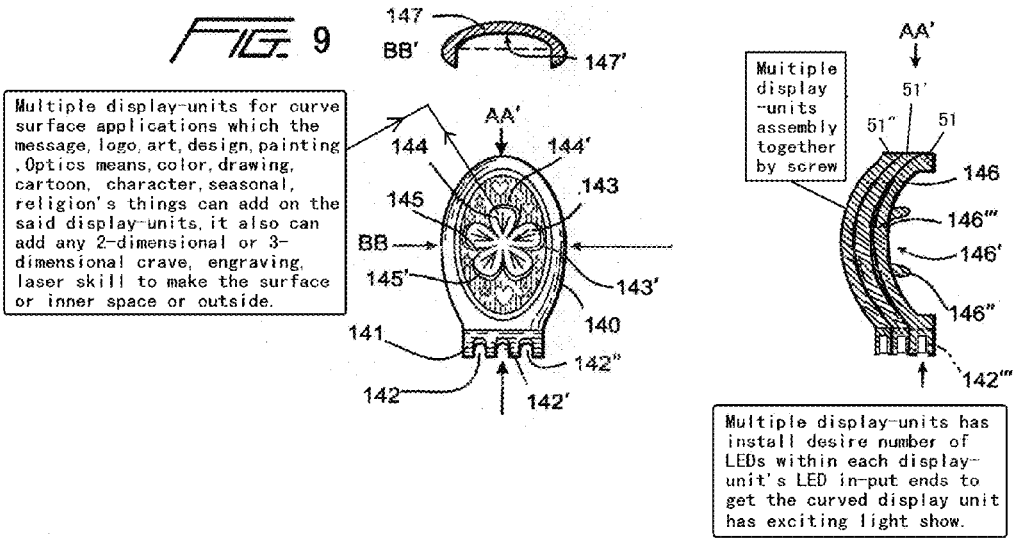
FIG. 9 illustrates a curved and design of a display unit which, although not a flat surface, still falls within the scope of the current invention.

FIG. 9 shows display units each having a curved surface or three-dimensional surface with carving, engraving, or laser processing to obtain a 3D image, message, or photos within the display unit. The LEDs may be colorful or have auto color-changing functions to cause the inner message, logo, art, design, painting, optics means, color, drawing, cartoon, character, seasonal image, or religious image or message to glow. The three-dimensional carving, engraving, or laser skill and be applied to an inner or outer surface and the multiple display-units may be assembled by screws, sonic welding, or glue.

Figure 10:
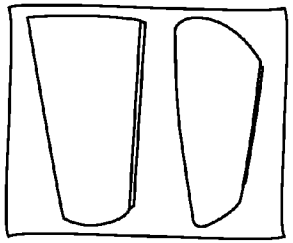

FIG. 10 shows a wall lamp application of the present invention.

Figure 11:
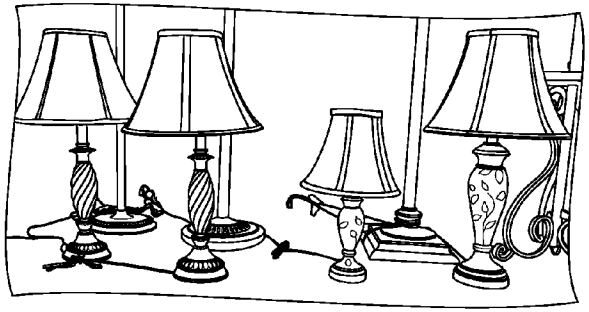
FIGS. 10-13 show preferred applications for the current invention.

FIG. 11 shows a desk top lamp having built-in multiple display units within a lampshade made of plastic, glass, or any light-passing.

Figure 12:
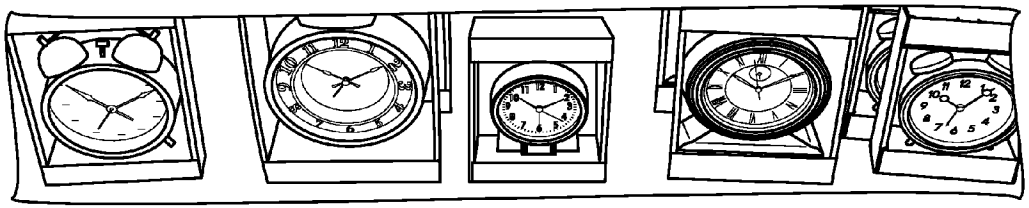

FIG. 12 shows a time piece application in the form of a wall-mounted or desk top analog time piece having a dial face with built-in multiple display-units for a variety of messages, images, cartoons, and/or characters for presentation to a consumer.

Figure 13:
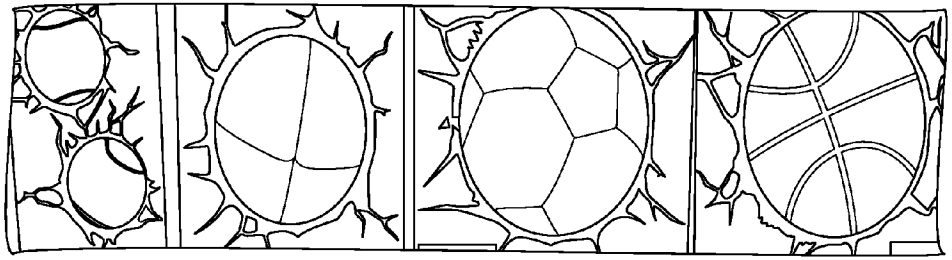

FIG. 13 shows a wall-mounted lamp. The light can also be used as a tap light for a desk top, and includes a spherical or ball-shaped plastic or blister surface which has a certain thickness and on which is printed a logo, design, or art. The light uses a multiple-display-units overlay to provide an exciting LED light show.

In summary, the present application discloses multiple display units that may individually take the form of the single display units shown in parent application Ser. No. 11/527,629, filed Sep. 27, 2006, and illustrated herein in FIGS. S, S1, S2, S3, and S4. Each display-unit may have its own LED(s) controlled by an IC and circuitry to cause the different display-unit(s) to exhibit motion effects with respect to colors, images, messages, logos, words, and changeable screens and thereby achieve an eye-catching light performance for all viewers. The multiple display units may further utilize the sealed-unit construction illustrated in FIG. S, to provide a universal model that can fit all kinds of night light device.

It is to be appreciated that the above-described embodiments are not to be limited by details provided in the description thereof, and that any equivalent function, replacement, alternative process, treatments, experiments, and arrangements may still belong within the scope of the current invention.

The invention claimed is:

1. A multiple-display-unit LED light device having special light effects, comprising:

a plurality of different display units each having a different treatment on a display area and a display input end through which light from at least one LED is transmitted to said display area, each display input end of each of said different display units being arranged to be received in a holder or housing means, said holder or housing means having at least one prong means or other electric power signal delivery means for connecting with a non-portable power source and one means for receiving the display input ends of said plurality of different display units;

said at least one LED connected by circuitry to a control means and/or integrated circuit (I.C.) means and the prong means or electric signal delivery means, to cause the at least one LED to turn on and turn off for a period of time and to exhibit predetermined illumination effects of the individual display unit or all display units, said predetermined illumination effects selected from the group consisting of flashing, steady-on, chasing, random flashing, pair flashing, color changing, auto color changing, selected color effects, and color-freezing effects of each individual display-unit and/or all display-units, wherein:

the at least one LED for each display unit is installed directly within the holder or housing means or within a receptacle means by fixing means or assembly means to supply the light into the said display area of each respective display unit, the display input end includes means for receiving said at least one LED when said display input end is inserted into said receptacle means or fixed on the holder or housing means and for transmitting light from the at least one LED to the respective display area of each different display unit, the at least one LED is connected with a printed circuit board (PCB), and each LED has a light blocking means for preventing the light from the respective LED from being emitted into a wrong display unit and interfere with the LED light show, function, effects, or performance, at least one of the display units is a single piece, and the display area of the at least one of the display units further has a predetermined design selected from the group consisting of art, a drawing, a design, a geometric shape, a cartoon, a character, a sign, painting, at least one window, a silkscreen, heat transfer art, openings, cut-outs, optics means, an LCD screen, digital data, a message, words, a religious symbol, an advertisement, a warning sign, commercial data, colors, a texture, optics treatment, a holiday message, a festival message, a seasonal message, and holes on a surface or within the unit to provide desired lighting effects and performance, said receptacle means or holder or housing means is arranged to receive all display units' input ends, and the LED light device is one of a plug-in night light, table desk LED light, wall mounted LED light, sign, commercial light box, evacuation sign, advertisement sign, analog time piece, desk top lamp, clock, light tube, toy, projection light, mobile phone surface panel, communication device, computer device, suction cup LED battery light, Christmas tree light with battery or pigtail wire, USB light device, and consumer electric device, the LED light device having a relatively large or non-portable power source that provides sufficient capacity to power the multiple LEDs for the multiple display units.

2. The multiple-display-unit LED light device having special light effects as claimed in claim 1, wherein each said display unit has its own art, design, character, word, logo, sign, geometric shape, color, painting, silkscreen, optics means, light-passing-through-means, semi-transparent means, block-out means, transparent means, plastic resin, air bubble, cut outs, opening, windows, colors, characters, cartoon figure, holiday art, seasonal signals, greeting words, commercial advertisement, promotion words, time, digital data display, LCD display screen, monitor screen, sign, or message.

3. The multiple-display-unit LED light device having special light effects as claimed in claim 1, wherein at least one of the light blocking means is a metalized sheet, or a piece made of plastic, paper, wood, or other opaque material.

4. The multiple-display-unit LED light device having special light effects as claimed in claim 1, wherein the non-portable power source includes one of a plug-in prong means to get the home electricity or means for obtaining power from a USB port, computer, laptop, transformer, adaptor, invertor, charger, USB charger, solar power, chemical power for any surface installation including a desk top, table, wall, or floor for indoor or outdoor use.

5. The multiple-display-unit LED light device having special light effects as claimed in claim 1, wherein at least one of the means to deliver the power signal to the at least one LED is selected from the group consisting of a prong means, socket means, AC outlet means, pig-tail wire sets, an adaptor plug, plug and receptacle means, socket means, quick connector means, plug and socket means, and USB plug and port means.

6. The multiple-display-unit LED light device having special light effects as claimed in claim 1, wherein the at least one LED includes at least one single or multiple color LED that fits within a respective said display unit input end to cause the light to pass into the display unit and illuminate the art, words, geometric shape, message, data, digital data display, display screen, or monitor screen.

7. The multiple-display-unit LED light device having special light effects as claimed in claim 1, wherein said integrated circuit controls the light performance for all said display units.

8. The multiple-display-unit LED light device having special light effects as claimed in claim 1, wherein the optics means is selected from a transparent or translucent means, a light reflective means, a light deviation means, a retro-reflect means, a light refraction means, an interface means, a convex lens, a concave lens, a focusing means, a superposition and interference means, a diffraction means, an optical resolution means, a dispersion means, a scattering means, and a polarization means so as to create more eye-catching light effects.

9. The multiple-display-unit LED light device having special light effects as claimed in claim 1, wherein a switch means to turn on and turn off the LED device is selected from the group consisting of a sensor, remote control, magnetic means, motion sensor, timer, heater, moisture means, flood means, photo sensor, Bluetooth means, sound activate switch, WiFi signal receiver, Internet signal receiver, and a transmitter and receiver means.

10. The multiple-display-unit LED light device having special light effects as claimed in claim 1, wherein said non-portable power source has a capacity of over 500 ma and is selected from a carbon battery and alkaline battery having a size selected from AAA, AA, Sub C, C, or larger.

11. The multiple-display-unit LED light device having special light effects as claimed in claim 1, wherein said LED light device includes a suction cup to install on a wall, surface, window, or glass.

12. A multiple-display-unit LED light device having special light effects, comprising:

a plurality of different display units each having a different treatment on a display area and a display input end through which light from at least one LED is transmitted to said display area, each display input end of each of said different display units being arranged to be received in a holder or housing means, said holder or housing means having at least one prong means or other electric power signal delivery means for connecting with a non-portable power source and one means for receiving the display input ends of said plurality of different display units;

said at least one LED connected by circuitry to a control means, integrated circuit (I.C.) means, and the prong means or electric signal delivery means, to cause the at least one LED to turn on and turn off for a period of time and to exhibit predetermined illumination effects of the individual display unit or all display units, said predetermined illumination effects selected from the group consisting of flashing, steady-on, chasing, random flashing, pair flashing, color changing, auto color changing, selected color effects, and color-freezing effects of each individual display-unit and/or all display-units, wherein:

the at least one LED for each display unit is installed directly within the holder or housing means or within a receptacle means by fixing means or assembly means to supply the light into the said display area of each respective display unit, the display area of at least one of the display units includes a space for at least one filler selected from the group consisting of a liquid, chemical compound, miniature objects, floating stuff, reflective pieces, liquids of different density, a printed background, a screen, and a combination of said fillers, and the display input end includes means for receiving said at least one LED when said display input end is inserted into said receptacle means or fixed on the holder or housing means and for transmitting light from the at least one LED to the respective display area of each different display unit, the at least one LED is connected with a printed circuit board (PCB), and each LED has a light blocking means for preventing the light from the respective LED from being emitted into a wrong display unit and interfere with the LED light show, function, effects, or performance, the display area of the at least one of the display units further has a predetermined design selected from the group consisting of art, a drawing, a design, a geometric shape, a cartoon, a character, a sign, painting, at least one window, a silkscreen, heat transfer art, openings, cutouts, optics means, an LCD screen, digital data, a message, words, a religious symbol, an advertisement, a warning sign, commercial data, colors, a texture, optics treatment, a holiday message, a festival message, a seasonal message, and holes on surface or within the unit to provide desired lighting effects and performance, said receptacle means or holder or housing means is arranged to receive all display units' input ends, and the LED light device is one of a plug-in night light, table desk LED light, wall mounted LED light, sign, commercial light box, evacuation sign, advertisement sign, analog time piece, desk top lamp, clock, light tube, toy, projection light, mobile phone surface panel, communication device, computer device, suction cup LED battery light, Christmas tree light with battery or pigtail wire, USB light device, and consumer electric device, the LED light device having a relatively large or non-portable power source that provides sufficient capacity to power the multiple LEDs for the multiple display units.

13. The multiple-display-unit LED light device having special light effects as claimed in claim 12, wherein each said display unit has its own art, design, character, word, logo, sign, geometric shape, color, painting, silkscreen, optics means, light-passing-through means, semi-transparent means, block-out means, transparent means, plastic resin, air bubble, cut outs, opening, windows, colors, characters, cartoon figure, holiday art, seasonal signals, greeting words, commercial advertisement, promotion words, time, digital data display, LCD display screen, monitor screen, sign, or message.

14. The multiple-display-unit LED light device having special light effects as claimed in claim 12, wherein at least one of the light blocking means is a metalized sheet, or a piece made of plastic, paper, wood, or other opaque material.

15. A multiple-display-unit LED light device having special light effects, comprising:

a plurality of different display units each having a different treatment on a display area and a display input end through which light from at least one LED is transmitted to said display area, each display input end of each of said different display units being arranged to be received in a holder or housing means, said holder or housing means having at least one prong means or other electric power signal delivery means for connecting with a non-portable power source and one means for receiving the display input ends of said plurality of different display units;

said at least one LED connected by circuitry to a control means, integrated circuit (I.C.) means, and the prong means or electric signal delivery means, to cause the at least one LED to turn on and turn off for a period of time and to exhibit predetermined illumination effects of the individual display unit or all display units, said predetermined illumination effects selected from the group consisting of flashing, steady-on, chasing, random flashing, pair flashing, color changing, auto color changing, selected color effects, and color-freezing effects of each individual display-unit and/or all display-units, wherein:

the at least one LED for each display unit is installed directly within the holder or housing means or within a receptacle means by fixing means or assembly means to supply the light into the said display area of each respective display unit, the display area of at least one of the display units has a geometric shape, a curved one, two, or three dimensional shape with carving, engraving, laser-carving, a 3D image within a plastic resin, or bubbles within a solid plastic resin to provide a three-dimensional effect and enable designs, artwork, characters, drawings, and cartoons to appear more lifelike, and the display input end includes means for receiving said at least one LED when said display input end is inserted into said receptacle means or fixed on the holder or housing means and for transmitting light from the at least one LED to the respective display area of each different display unit, the at least one LED is connected with a printed circuit board (PCB), and each LED has a light blocking means for preventing the light from the respective LED from being emitted into a wrong display unit and interfere with the LED light show, function, effects, or performance, the display area of the at least one of the display units further has a predetermined design selected from the group consisting of art, a drawing, a design, a geometric shape, a cartoon, a character, a sign, painting, at least one window, a silkscreen, heat transfer art, openings, cutouts, optics means, an LCD screen, digital data, a message, words, a religious symbol, an advertisement, a warning sign, commercial data, colors, a texture, optics treatment, a holiday message, a festival message, a seasonal message, and holes on surface or within the unit to provide desired lighting effects and performance, said receptacle means or holder or housing means is arranged to receive all display units' input ends, and the LED light device is one of a plug-in night light, table desk LED light, wall mounted LED light, sign, commercial light box, evacuation sign, advertisement sign, analog time piece, desk top lamp, clock, light tube, toy, projection light, mobile phone surface panel, communication device, computer device, suction cup LED battery light, Christmas tree light with battery or pigtail wire, USB light device, and consumer electric device, the LED light device having a relatively large or non-portable power source that provides sufficient capacity to power the multiple LEDs for the multiple display units.

16. A multiple-display-unit LED light device having special light effects, comprising:

a plurality of different display units each having a different treatment on a display area and a display input end through which light from at least one LED is transmitted to said display area, each display input end of each of said different display units being arranged to be received in a holder or housing means, said holder or housing means having at least one prong means or other electric power signal delivery means for connecting with a non-portable power source and one means for receiving the display input ends of said plurality of different display units;

said at least one LED connected by circuitry to a control means, integrated circuit (I.C.) means, and the prong means or electric signal delivery means, to cause the at least one LED to turn on and turn off for a period of time and to exhibit predetermined illumination effects of the individual display unit or all display units, said predetermined illumination effects selected from the group consisting of flashing, steady-on, chasing, random flashing, pair flashing, color changing, auto color changing, selected color effects, and color-freezing effects of each individual display-unit and/or all display-units, wherein:

the at least one LED for each display unit is installed directly within the holder or housing means or within a receptacle means by fixing means or assembly means to supply the light into the said display area of each respective display unit, the display input end includes means for receiving said at least one LED when said display input end is inserted into said receptacle means or fixed on the holder or housing means and for transmitting light from the at least one LED to the respective display area of each different display unit, the at least one LED is connected with a printed circuit board (PCB), and each LED has a light blocking means for preventing the light from the respective LED from being emitted into a wrong display unit and interfere with the LED light show, function, effects, or performance, the display area of at least one of the display units includes a container with space for at least one filler selected from the group consisting of a liquid, chemical compound, miniature objects, floating stuff, reflective pieces, liquids of different density, a printed background, a screen, a solid plastic resin with an air bubble inside, and a combination of said fillers, the display area of another one of the display units further has a predetermined design selected from the group consisting of art, a drawing, a design, a geometric shape, a cartoon, a character, a sign, painting, at least one window, a silkscreen, heat transfer art, openings, cut-outs, optics means, an LCD screen, digital data, a message, words, a religious symbol, an advertisement, a warning sign, commercial data, colors, a texture, optics treatment, a holiday message, a festival message, a seasonal message, and holes on surface or within the unit to provide desired lighting effects and performance, said receptacle means or holder or housing means is arranged to receive all display units' input ends, and the LED light device is one of a plug-in night light, table desk LED light, wall mounted LED light, sign, commercial light box, evacuation sign, advertisement sign, analog time piece, desk top lamp, clock, light tube, toy, projection light, mobile phone surface panel, communication device, computer device, suction cup LED battery light, Christmas tree light with battery or pigtail wire, USB light device, and consumer electric device, the LED light device having a relatively large or non-portable power source that provides sufficient capacity to power the multiple LEDs for the multiple display units.

17. A multiple-display-unit LED light device having special light effects, comprising:

a plurality of different display units each having a different treatment on a display area and a display input end through which light from at least one LED is transmitted to said display area, each display input end of each of said different display units being arranged to be received in a holder or housing means, said holder or housing means having at least one prong means or other electric power signal delivery means for connecting with a non-portable power source and one means for receiving the display input ends of said plurality of different display units;

said at least one LED connected by circuitry to a control means, integrated circuit (I.C.) means, and the prong means or electric signal delivery means, to cause the at least one LED to turn on and turn off for a period of time and to exhibit predetermined illumination effects of the individual display unit or all display units, said predetermined illumination effects selected from the group consisting of flashing, steady-on, chasing, random flashing, pair flashing, color changing, auto color changing, selected color effects, and color-freezing effects of each individual display-unit and/or all display-units, wherein:

the different treatments on each display area includes treatments selected from the group consisting of geometric art, shaping, painting, a logo, words, a sign, a message, an image, a screen, a display, an evacuation sign, a direction, a time display, optical treatment, a holiday symbol, a seasonal drawing, a commercial or advertisement message, or data within the said display area so as to provide, when illuminated by said at least one LED, a predetermined light show, message presentation, commercial promotion, moving image, or data to viewers, each display unit includes at least one of a switch, photo sensor, sensor, motion sensor, remote control, or Bluetooth controller to turn on and turn off the LED light device for a predetermined timing, duration, and period of time, the holder or housing means is arranged for any surface installation not including being worn by a person, and the LED light device has indoor, outdoor, festival, showtime, suction cup LED battery light, Christmas tree light with battery or pigtail wire, or USB light kit applications.

* * * * *